United States Patent [19]

Chaplin

[11] Patent Number: 4,655,683

[45] Date of Patent: Apr. 7, 1987

[54] STATOR SEAL LAND STRUCTURE

[75] Inventor: Gary F. Chaplin, Vernon, Conn.

[73] Assignee: United Technologies Corporation, Hartford, Conn.

[21] Appl. No.: 686,175

[22] Filed: Dec. 24, 1984

[51] Int. Cl.[4] ..... F01D 11/02; F01D 9/02

[52] U.S. Cl. ..... 415/137; 415/174

[58] Field of Search ..... 415/136, 137, 138, 174, 415/170 R, 139

[56] References Cited

U.S. PATENT DOCUMENTS

| | | | |
|---|---|---|---|
| 2,488,867 | 11/1949 | Judson | 415/136 |
| 3,018,085 | 1/1962 | Welsh | 415/136 |
| 3,411,794 | 11/1968 | Allen | 415/174 |
| 3,829,233 | 8/1974 | Scalzo et al. | 415/136 |
| 3,874,824 | 4/1975 | Cronstedt et al. | 417/406 |
| 3,941,500 | 3/1976 | Glenn | 415/136 |
| 4,005,946 | 2/1977 | Brown et al. | 415/136 |
| 4,011,718 | 3/1977 | Asplund | 60/39.31 |
| 4,083,648 | 4/1978 | Asplund | 415/137 |
| 4,103,899 | 8/1978 | Turner | 277/1 |
| 4,159,623 | 7/1979 | McReynolds | 60/39.15 |
| 4,184,689 | 1/1980 | Brodell et al. | 277/26 |
| 4,251,185 | 2/1981 | Karstensen | 415/136 |
| 4,318,668 | 3/1982 | Chaplin et al. | 415/135 |
| 4,432,555 | 2/1984 | Langley | 277/25 |
| 4,470,757 | 9/1984 | Vollinger | 416/221 |

*Primary Examiner*—Everette A. Powell, Jr.
*Attorney, Agent, or Firm*—Robert C. Walker

[57] ABSTRACT

A stator seal land and supporting structure suitable for use in an axial flow rotary machine is disclosed. Included are concepts for matching the thermal response of the seal land to the rotor assembly and for inhibiting rolling or twisting of the seal land under changing thermal conditions. The seal land is free to expand and contract in diameter independently of the supporting stator structure.

1 Claim, 2 Drawing Figures

STATOR SEAL LAND STRUCTURE

DESCRIPTION

1. Technical Field

Figure 1:
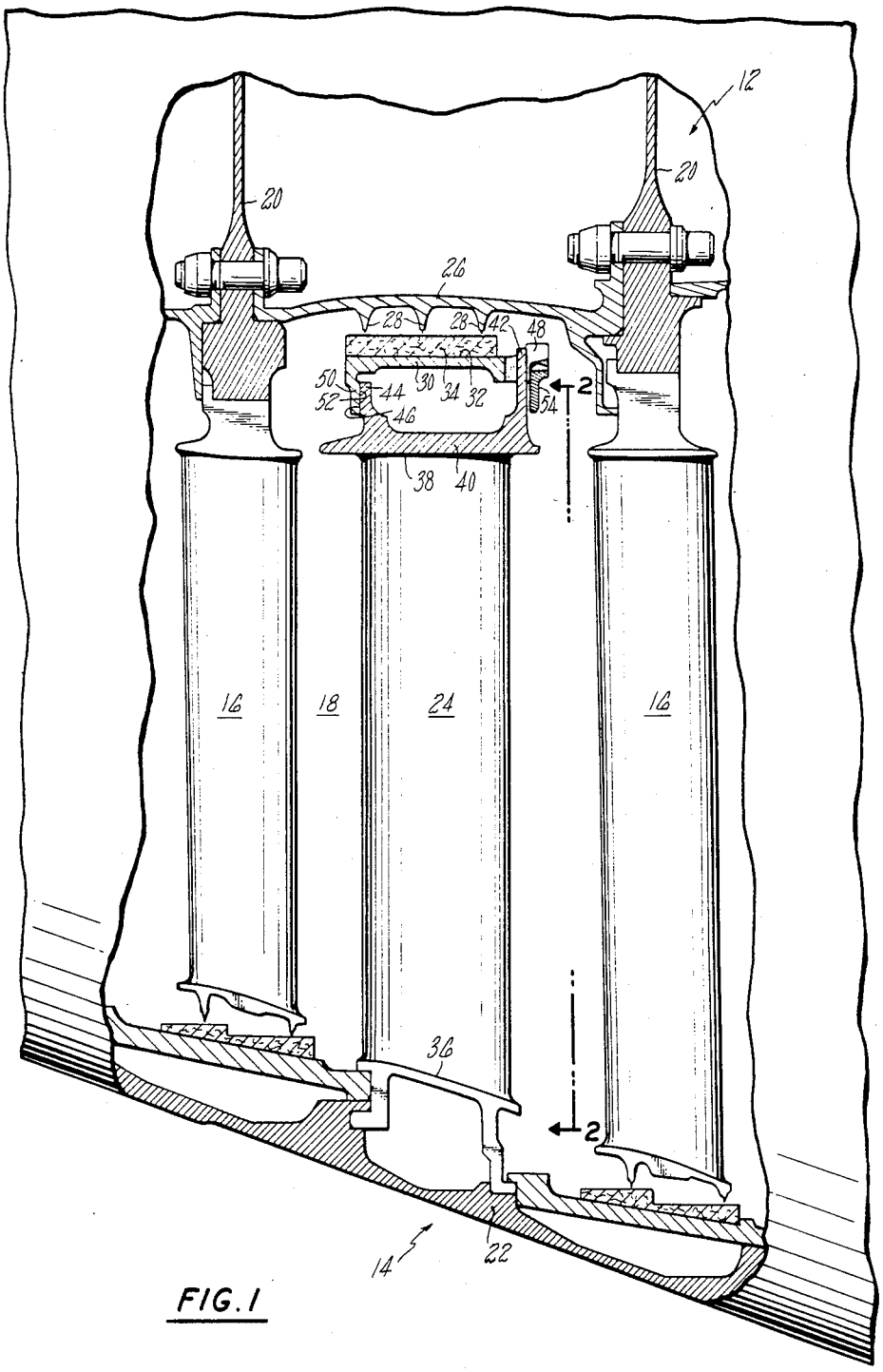

This invention relates to axial flow rotary machines, and in particular, to interstage seals between adjacent rotor blade rows.

The concepts were developed for use in the turbine and compressor sections of gas turbine engines, but may have wider applicability as well.

2. Background Art

An axial flow gas turbine engine principally includes a stator assembly and a rotor assembly. Rows of rotor blades on the rotor assembly and rows of stator vanes on the stator assembly extend alternately across an axially oriented flowpath for working medium gases.

An interstage seal is formed between the stator assembly and the rotor assembly between each pair of adjacent rotor blade rows. At a typical interstage seal, a labyrinth of adjacent knife edges on the rotor assembly extend radially into proximity with a cylindrical seal land on the stator assembly. The following U.S. Patents contain illustrations representative of such structures: U.S. Pat. Nos. 4,005,946 to Brown et al entitled "Method and Apparatus for Controlling Stator Thermal Growth"; 4,011,718 to Asplund entitled "Gas Turbine Construction"; 4,083,648 to Asplund entitled "Gas Turbine Construction"; 4,103,899 to Turner entitled "Rotary Seal with Pressurized Air Directed at Fluid Approaching the Seal"; 4,351,532 to Laverty entitled "Labyrinth Seal" and 4,470,757 to Vollinger entitled "Sideplate Retention for a Turbine Rotor".

In all of the above structures, an essential goal is to maintain close correspondence of the rotor components and the stator components forming the interstage seal such that the leakage of air therebetween is minimized. Maintaining close correspondence includes both matching the diameters of the two elements over the engine cycle and minimizing distortion of both components.

Notwithstanding the availability of the above systems and structures, scientists and engineers in the industry have continued to search for structures having improved sealing effectiveness.

DISCLOSURE OF THE INVENTION

According to the present invention, the stator element of an interstage seal between the stator assembly and the rotor assembly of a gas turbine engine is splined to supporting structure at one end and guided by a radially oriented surface at the other end such that the diameter of the stator element is independent of the diameter of the structure supporting such element.

According to one detailed embodiment of the invention, the stator element is a cylindrical seal land having a U-shaped cross sectional geometry with the legs of the "U" extending radially outwardly on the element to prevent rolling or twisting of the land under varying thermal conditions.

Primary features of the present invention are the stator element of the interstage seal and the inner shroud of the vane stage supporting the stator interstage seal element. The diameter of the seal element is independent of the diameter of the inner shroud. Other features include the spline formed by the lugs of the inner shroud in engagement with slots of the inner shroud, and the opposing radial surfaces of the inner shroud and of the seal element. The seal element in the embodiment illustrated has a U-shaped cross section for preventing rolling and twisting of the seal element.

Principal advantages of the present invention are the capability of the stator seal element to expand and contract in diameter independent of the vanes and inner shroud. In the seal type illustrated, close tolerances between the land of the stator element and the seal knife edges circumscribed thereby are maintained. Additionally, the U-shaped cross section is stable under varying thermal conditions leaving the cylindrical surface forming the seal land free of distortion.

The foregoing, and other features and advantages of the present invention will become more apparent in light of the following description and accompanying drawing.

BRIEF OF THE DRAWING

Figure 2:
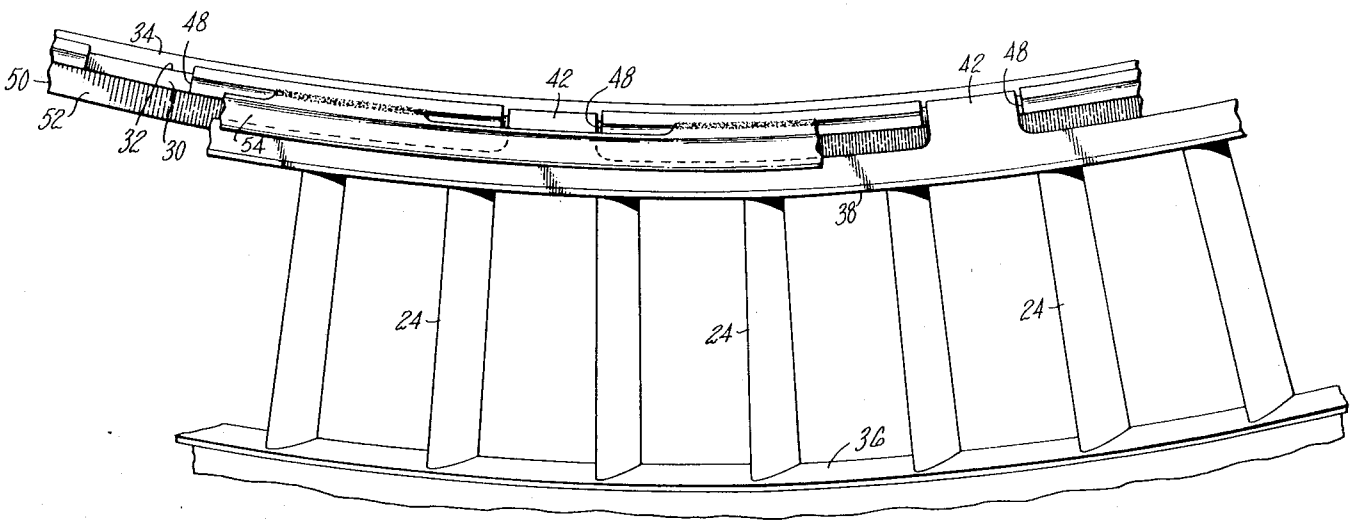

FIG. 1 is a simplified cross section view taken through the turbine section of a gas turbine engine; and FIG. 2 is a sectional view taken along the line 2—2 of FIG. 1.

BEST MODE FOR CARRYING OUT THE INVENTION

The best mode for carrying out the invention is illustrated in the turbine section of a gas turbine engine. The concepts are equally applicable to interstage seals of the engine compressor.

A portion of the turbine section of a gas turbine engine is shown in FIG. 1. Elements of the rotor assembly 12 and the stator assembly 14 are shown. The rotor assembly includes rows of rotor blades 16 extending outwardly across a flowpath 18 for working medium gases from rotor disks 20 toward a stator case 22. A row of stator vanes, as represented by the single vane 24, extends inwardly across the flowpath toward a spacer 26. The spacer bridges the gap between the adjacent rotor disks.

Seal means disposed between the vanes 24 and the spacer 26 isolates the adjacent rows of blades 16, one from the other. The seal means described and illustrated in this embodiment is of the labyrinth type in which a plurality of knife edge rings 28 extend outwardly of the spacer toward a stator seal element or seal land 30. The land has a cylindrical surface 32 opposing the knife edges of the spacer. A porous facing material 34, such as feltmetal, is adhered to the land.

The stator seal element or land 30 is supported through intermediate structure by the stator case 22. The vanes 24 extend inwardly from the engine case. In a typical turbine installation, vanes are clusted in units of three to six (3–6) vanes joined at the outer ends thereof at platforms 36 and at the inner ends thereof at platforms 38. In composite the inner ends of the platforms form an inner shroud 40. In compressor embodiments, the inner shroud is conventionally a continuous annular ring into which the inner ends of the vanes are inserted.

The inner shroud 40 has, at one end thereof, a plurality of lugs 42 extending radially inwardly toward the spacer 26 between adjacent rotor disks. At the other end of the shroud is a flange 44 having a forwardly facing, radially oriented surface 46.

The stator seal element or land 30 has a plurality of axially extending slots 48 at the end thereof corresponding to the lugs 42 at the end of the inner shroud. The slots are equal in number to and in circumferential alignment with the lugs. Each slot is engaged by a corresponding lug. The seal element further has on the other end a flange 50 having a forwardly facing, radially oriented surface 52. The surfaces 52 of the seal element and 46 of the inner shroud 40 are in opposing, abutting relationship. A retaining ring 54 is joined to the slotted end of the seal element in a manner trapping the lugs 42 in the slots 48 by axially closing the slots. The relationship of the lugs to the slots is further illustrated in the FIG. 2 sectional view.

As installed, the seal land 30 and the inner shroud 40 are free to position radially, independently of one another. The seal land 30 is supported by the lug 42 and slot 48 spline—floating to a selfcentering position thereupon. Floating the ring on a spline allows the seal ring to maintain roundness independent of structural influence conventionally exerted by the stator vanes 24 and inner shroud 40 upon the seal land.

The diameter of the seal land 30 is functionally related to the temperature of the engine in the region of the land. Concomitantly, the spacer 26, being in the region of the land, is exposed to like temperatures and tends to seek a like diameter. Closer correspondence of the knife edges 28 to the facing material 34 results and sealing effectiveness therebetween improved.

Of additional benefit, the described construction, when compared to those of the prior art, enables a reduced cavity height between the spacer 26 and the flowpath 18. Reducing the cavity height reduces windage losses as the rotor rotates relative to the stator and reduces inherent pumping along the radial surfaces of the rotor. Improved overall engine performance is enabled.

Welding the retaining ring 54 to the seal land 30 is a preferred method of attachment in that the U-shaped structure formed, aids in maintaining seal roundness under varied thermal conditions. Rolling or twisting of the cylindrical land is resisted. Rearward aerodynamic loading of the structure during operation causes the seal land to adjust rewardly against the surface 46 of inner shroud 40. A seal between the inner shroud and the seal land is effected.

It should be understood that the invention is not limited to the particular embodiments shown and described herein, but that various changes and modifications may be made without departing from the spirit and scope of this novel concept as defined by the following claims.

I claim:

1. A stator assembly of the axial flow, rotary machine type including a plurality of stator vanes extending radially inwardly across a flowpath for working medium gases from a stator case into engagement with an inner shroud supporting a seal land, wherein the improvement comprises:

an inner shroud extending circumferentially about the flowpath and having both a plurality of lugs extending radially inwardly therefrom at one end of the shroud and a flange having a radially oriented surface at the other end of the shroud;

a seal land having a plurality of slots equal in number to and spaced in circumferential alignment with the lugs of the shroud and engaged thereby, and a flange having a radially oriented surface in opposing, abutting relationship to the surface of the shroud; and a retaining ring affixed to the seal land in a manner axially closing the slots with the lugs extending therethrough and forming, in conjunction with the flange of the seal land, a structure of U-shaped cross section with the legs of the "U" extending radially for stability under changing temperature conditions and whereby the seal land and the inner shroud are free to move radially relative to one another in response to differing thermal conditions.

* * * * *